United States Patent [19]

Wyszkowski et al.

[11] 4,391,654

[45] Jul. 5, 1983

[54] METHOD OF THERMO-CHEMICAL TREATMENT OF CUTTING TOOLS AND PLASTIC WORKING TOOLS

[75] Inventors: Jerzy Wyszkowski; Władysław Panasiuk; Stanisław Koprek; Andzei Piechal, all of Warsaw, Poland

[73] Assignee: Instytut Mechaniki Precyzyjnej, Warsaw, Poland

[21] Appl. No.: 275,709

[22] Filed: Jun. 22, 1981

[30] Foreign Application Priority Data

Jul. 4, 1980 [PL] Poland ..... 225459

[51] Int. Cl.[3] ..... C23F 7/04

[52] U.S. Cl. ..... 148/16.6; 148/6.35

[58] Field of Search ..... 148/6.35, 16.6

[56] References Cited

U.S. PATENT DOCUMENTS 3,748,195 7/1973 Kondo et al. ..... 148/6.16

FOREIGN PATENT DOCUMENTS 53-23841 3/1978 Japan ..... 148/16.6

55-134172 10/1980 Japan ..... 148/16.6

OTHER PUBLICATIONS

Chem. Abstracts 90:155466p (1979).

*Primary Examiner*—Sam Silverberg

*Attorney, Agent, or Firm*—Ladas & Parry

[57] ABSTRACT

The invention is addressed to preventing full reduction of oxides and enabling nitriding temperature through the oxidized layer to be raised which leads in a relatively shorter time, to formation of thicker and harder superficial layers, diffusion saturated with nitrogen.

This aim has been achieved by carrying on the tool oxidation process advantageously for the whole time of the gas nitriding process, the said oxidation process accompanying the gas nitriding process being carried on in steam consisting 5 to 0.5 percent by volume of the whole gas atmosphere, the atmosphere of dissociated ammonia being obtained by the dissociation of ammonia at the presence of steam, the process of a simultaneous nitriding and oxidation of tools being carried on for an arbitrary period of time.

4 Claims, No Drawings

METHOD OF THERMO-CHEMICAL TREATMENT OF CUTTING TOOLS AND PLASTIC WORKING TOOLS

This invention relates to an improvement of thermo-chemical treatment of cutting and plastic working tools.

The method of thermo-chemical treatment of cutting tools and plastic working tools made of high-speed, high-chromium ledeburitic and high chromium economical steel is characterized in that the tools are first oxidized in steam at temperatures of 520 to 570 degrees Centigrade for 30 to 120 minutes which leads to the formation of a thin layer of oxides of $Fe_3O_4$ type of the order of 2 to 6 μm having a structure of monometallic spinels over the surface of the tool, and next said tools are subjected to gas nitriding in an atmosphere of dissociated ammonia at a temperature of 520 to 580 degrees Centigrade for 15 to 120 minutes.

The thickness of layer of $Fe_3O_4$ type oxide after the oxidation of the grinded tools in steam cannot exceed 8 μm; this thickness is subject to the so called parabolic oxidation law. At the time of nitriding through the oxidized porous layer the said layer is being reduced, this being due to the action of hydrogen obtained from the dissociation of ammonia. It is sufficient to raise the nitriding temperature by 5 to 10 degrees relative to the temperature of the preceding oxidation while maintaining the nitriding time identical as the oxidizing time in order to obtain full reduction of the oxide layer. Full reduction of this layer during the next stage of nitrifing /prolongation of the nitrifing time with respect to the oxidizing time/ leads to the formation of the mixture of epsilon and gamma prim brittle and soft phases leading as a rule to brittleness of tools. In such a case the service life of tools is shorter.

This invention has been aimed at preventing full reduction of oxides and enabling nitriding temperature to be raised by the previously oxidized layer which leads to the formation, in a relatively short time, to a considerably thicker and more durable superficial layers, diffusion saturated with nitrogen.

This aim has been achieved by carrying on the tool oxidation process advantageously during the time during which the gas nitriding process is performed, the said oxidizing process accompanying the gas nitriding process being effected in steam consisting 5 to 95 percent by volume of the whole gas atmosphere, the atmosphere of dissociated ammonia being obtained by dissociation of ammonia at the pesence of steam, the process of simultaneous nitriding and oxidizing of tools being carried on for an arbitrary period of time.

The oxidation accompanying the gas nitriding process should be performed immediately after the preliminary oxidation of tools without opening the furnace.

The oxidation accompanying the gas nitriding process should preferably be performed after an arbitrarily long time from the moment of completion of the process of preliminary oxidation of tools.

Moreover, both the process of preliminary oxidation of tools, as well as the process of simultaneous oxidation and gas nitriding of tools should be performed in a bed of a bulk material, e.g. sand.

Owing to the solution according to the invention, the nitriding temperature can be raised and the nitriding time can be simultaneously prolonged and this does not lead to full reduction of oxides and the possible formation of a harmful miixture of epsilon and gamma prim phases, which is particularly important in case of nitriding cutting and plastic working tools of large overall dimensions through an oxide layer.

The object of the invention has been presented beneath on examples of embodiment.

EXAMPLE I

Milling cutters for cutting grooves in blades of circular saws $\phi 115 \times 380$ mm made of steel grade S3-1-1-2, austenitized at a temperature of 1120 degrees Centigrade in a protective atmosphere produced from liquid organic compounds for 35 minutes and cooled down in oil at a temperature of 80 to 100 degrees Centigrade, then tempered three times at a temperature of 550 to 570 degrees Centigrade, have thereafter been subjected to nitro-oxidizing by means of the method according to this invention. Oxidation in steam takes place at a temperature of 520 degrees Centigrade for 30 minutes in a pit-type furnace of 40 kW power with removable retort with 0.2 cu.m. volume. Water consumption during the process was about 2 kgs per hour at overpressure of oxidizing atmosphere in the retort equal to 0.5 Kpa/50 mm water column. Nitro-oxidation was effected by introducing to the furnace a water solution of ammonia containing 50 percent of water by volume and 50 percent of ammonia by volume and having a temperature of 530 degrees Centigrade for a period of 240 minutes. Nitro-oxidation is performed in the same installation as oxidation at identical overpressure in the retort. Ammonia consumption amounted to about 380 cu.dcm. per hour, and steam consumption 900 cu.dcm. per hour. Milling cutters were used for machine teeth in blades may of high-speed steel with 285 BH max hardness number. Comparative cutting tests with the use of identical milling cutters which had been subjected to thermo-chemical treatment according to the invention in analogous cutting conditions shown that service life of milling cutters subjected to treatment according to the principles of this invention had been prolonged by 40 percent.

EXAMPLE II

Hole pull broaches of 30 mm dia, made of steel grade SG-5-2 austenitized at a temperature of 1210 degrees Centigrade in a protective atmosphere produced from liquid organic compounds for 25 minutes and cooled in oil at a temperature of 160 degrees Centigrade, then tempered three times at a temperature of 550 to 570 degrees Centigrade, were thereafter subjected to nitro-oxidation during the method according to the invention in a bed of fluidized sand. Specifically, the tools were first oxidized at a temperature of 540 degrees Centigrade for 30 minutes and next nitro-oxidized for 60 minutes at ammonia consumption 50 percent by volume and water consumption also 50 percent by volume at a temperature of 560 degrees Centigrade in a tube furnace. This has led to an increased hardness of 250 HV5. The said pull broaches were next used for broaching holes in structural alloy steel with 245 HB hardness number. As a result, the service life of the said tools has been prolonged by as much as 300 to 400 percent as compared with that of analogous pull broaches which had been hardened and tempered only.

We claim:

1. A method of thermo-chemically treated cutting tools or plastic working tools made of high-speed, high-chromium and ledeburitic steels comprising the steps of forming an oxide layer on the surfaces of said tools, said layer having a thickness of being not greater than 6 μm, and said layer being produced by oxidizing said tools in steam at a temperature within the range of 520 to 570 degrees Centigrade for 30 to 120 minutes, and gas nitriding the oxidized tools, for a period of time of at least 15 minutes in duration, in an atmosphere of dissociated ammonia at a temperature of 520 to 580 degrees Centigrade and simultaneously subjecting the oxidized tools to oxidation, in steam consisting of 5 to 95 percent by volume of the whole gas atmosphere, during any arbitrary interval of time occurring during said period whereby the atmosphere of dissociated ammonia is obtained by dissociation of ammonia in the presence of steam.

2. The method of claim 1 wherein the subjecting step is started, immediately after the oxide layer has been formed, without opening the furnace.

3. The method of claim 2 wherein the subjecting step is started after an arbitrary period of time has elasped after the oxide layer has been formed.

4. The method of claim 1, 2 or 3 wherein the forming, gas nitriding and subjecting steps are effected in a bed of bulk material.

* * * * *